US006472823B2

(12) United States Patent
Yen

(10) Patent No.: US 6,472,823 B2
(45) Date of Patent: Oct. 29, 2002

(54) LED TUBULAR LIGHTING DEVICE AND CONTROL DEVICE

(75) Inventor: George Yen, Taipei (TW)

(73) Assignee: Star Reach Corporation, Taipei (TW)

( * ) Notice: Subject to any disclaimer, the term of this patent is extended or adjusted under 35 U.S.C. 154(b) by 0 days.

(21) Appl. No.: 09/799,679

(22) Filed: Mar. 7, 2001

(65) Prior Publication Data

US 2002/0125839 A1 Sep. 12, 2002

(51) Int. Cl.[7] ..... H01J 13/32

(52) U.S. Cl. ..... 315/112; 315/117; 315/312; 315/362; 362/800; 340/815.45; 340/825.22

(58) Field of Search ..... 315/112, 117, 315/309, 312, 316, 362, 292; 362/800, 235, 240, 294, 373; 340/825.22, 815.45, 815.65, 815.75

(56) References Cited

U.S. PATENT DOCUMENTS 5,534,718 A * 7/1996 Chang ..... 257/774
6,016,038 A * 1/2000 Mueller et al. ..... 315/291
6,161,910 A * 12/2000 Reisenauer et al. ..... 315/158
6,255,786 B1 * 7/2001 Yen ..... 315/291

* cited by examiner

*Primary Examiner*—Haissa Philogene
(74) *Attorney, Agent, or Firm*—Troxell Law Office PLLC

(57) ABSTRACT

An LED tubular lighting device and control device includes LEDs planted in a transparent tube and controllable via a controller to obtain multifarious light sources. The tubular lighting device includes LEDs soldered onto a circuit board in an equi-distant arrangement. The circuit board with the LEDs is secured in a boat-shaped receiving, heat-dissipating trough, which are disposed in a transparent tube having heat-dissipating holes in the bottom wall thereof and through holes in both ends thereof. The LED tubular lighting devices can be connected in series and controllable to produce changes in colors and luminosity.

3 Claims, 3 Drawing Sheets

LED TUBULAR LIGHTING DEVICE AND CONTROL DEVICE

BACKGROUND OF THE INVENTION

1. Field of the Invention

The present invention relates to an LED tubular lighting device and control device.

2. Description of the Prior Art

High luminosity, bright colors, variety in light source combinations, and low power consumption are features of and reasons for the popularity of light emitting diodes (LED). In general, the color changes and combinations are achieved by passing electric currents and pulses through three basic colors of red, blue and green to generated multifarious light sources unsurpassed by other light sources or lighting devices. Moreover, through various combinations of colors and changes in luminosity, a dynamic lighting effect can be achieved. Therefore, LEDs are widely used in all kinds of display devices, visible light projectors and decorating devices.

Monochrome light bulbs with colors such as red, blue, purple, etc., that approximate pure colors have been successfully developed. Therefore, substrate materials for display devices and light source projectors using LEDs will be popular in the future. However, although LEDs have the aforementioned advantages, they are expensive and have heat dissipation problems. Manufacture of LED displays or light source projectors does not receive their due attention.

For LEDs applied to stage lighting, projection lighting fixtures, or decorative lighting devices, a multiplicity of LED light bulbs are tightly packed together to emit light or to perform light changes. They have the problems of high costs and poor heat dissipation; therefore, they are not widely accepted and incur unsatisfactory profits.

Aside from the aforesaid problems, conventional LED lighting devices are generally bulky and difficult to maintain. How to reduce costs and overcome the heat dissipation problem is a major subject to be resolved by manufacturers in the art.

SUMMARY OF THE INVENTION

The primary object of the present invention is to provide an LED tubular lighting device and control device. LEDs are planted in a transparent tube and are controllable via a controller to obtain multifarious light sources. The tubular lighting device includes LEDs soldered onto a circuit board in an equi-distant arrangement. The circuit board with the LEDs is secured in a boat-shaped receiving, heat-dissipating trough, which are disposed in a transparent tube having heat-dissipating holes in the bottom wall thereof and through holes in both ends thereof. The LED tubular lighting devices can be connected in series and controllable to produce changes in colors and luminosity.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
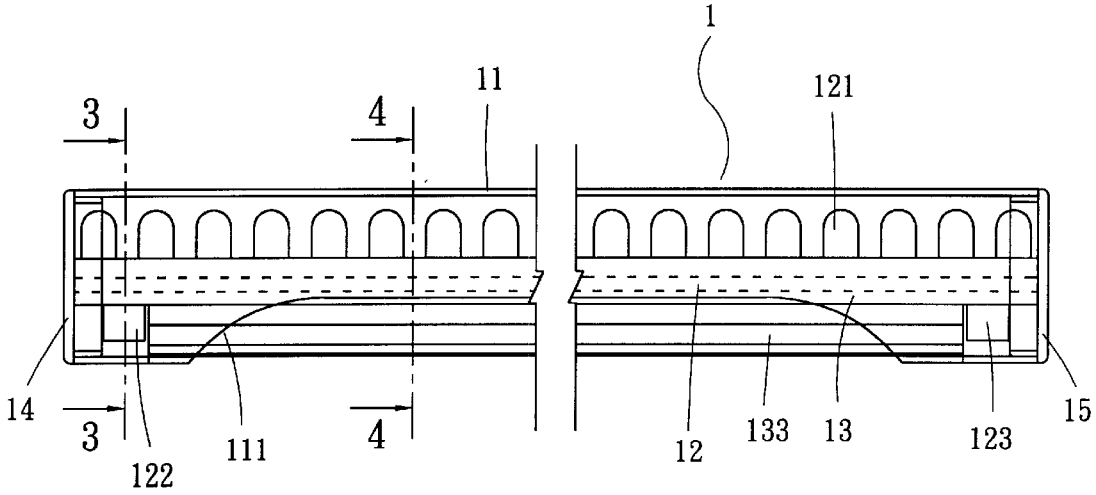
FIG. 1 is a longitudinal sectional view of a preferred embodiment of an LED tubular lighting device according to the present invention.
Figure 2:
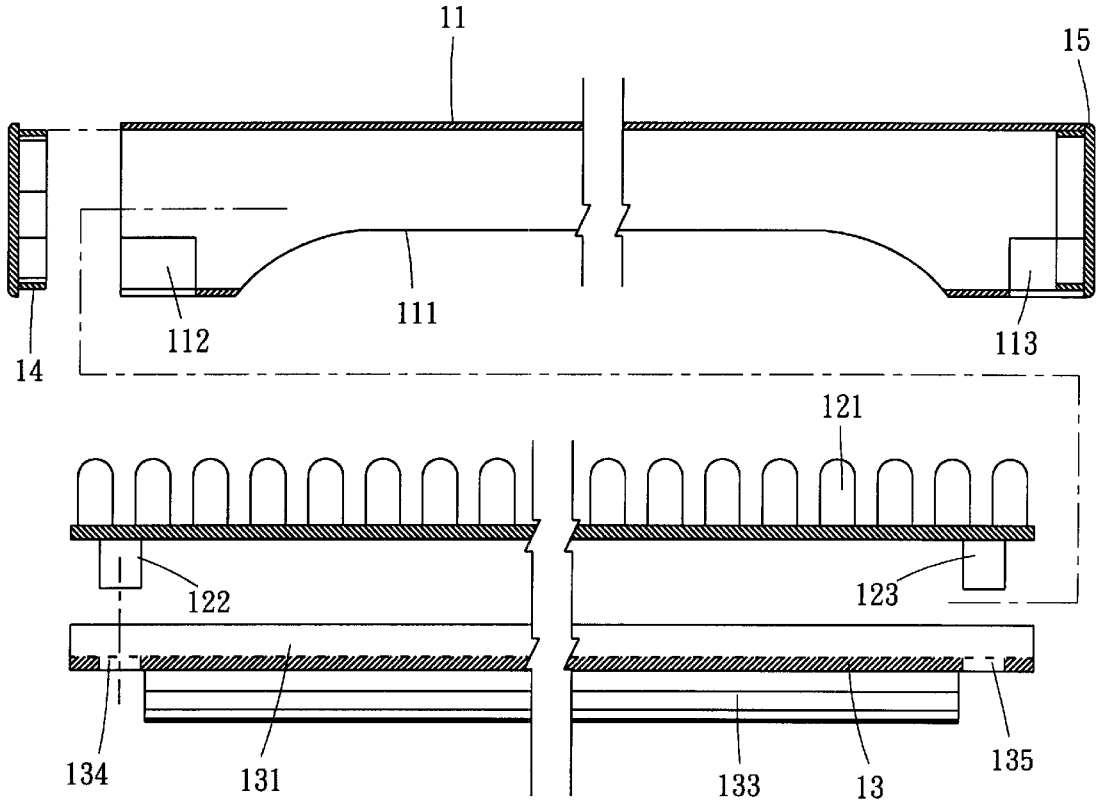
FIG. 2 is an exploded longitudinal sectional view of the preferred embodiment.

With reference to FIGS. 1 and 2, which are longitudinal sectional view and exploded view of the present invention, the preferred embodiment of an LED tubular lighting device 1 according to the present invention is shown to include a transparent tube 11, a strip-shaped circuit board 12, a boat-shaped receiving, heat-dissipating trough 13 and end stoppers 14, 15.

The circuit board 12 has equi-distantly spaced apart LED light bulbs 121 thereon, and can be secured on the circuit board 12 by soft solder. Two ends of the circuit board 12 are provided with input terminals 122 and output terminals 123.

The boat-shaped receiving, heat-dissipating trough 13 is a semi-circular boat-shaped aluminum-extruded receiving, light-converging, heat-dissipating trough with an outer surface resembling that of the transparent tube 11. An upper side thereof has a groove 131 for receiving the circuit board 12 holding the LED light bulbs 121. The center of the groove 131 is provided with a longitudinal recess 132. When the circuit board 12 is disposed in the groove 131, conductive metallic leg ends of the LED light bulbs 121 that pass through the rear side of the circuit board 12 may extend into the recess 132. The lower side of the boat-shaped receiving, heat-dissipating trough 13 is provided with heat-dissipating fins 133 that follow the curvature of the inner surface of transparent tube 11. Two ends of the groove 131 are provided with through holes 134, 135 corresponding to the input and output terminals 122, 123 to permit extension of the terminals therethrough and connection with a power source end. After the circuit board 12 with the LED light bulbs 121 is positioned, screws 136 are used to secure the same in place.

Figure 3:
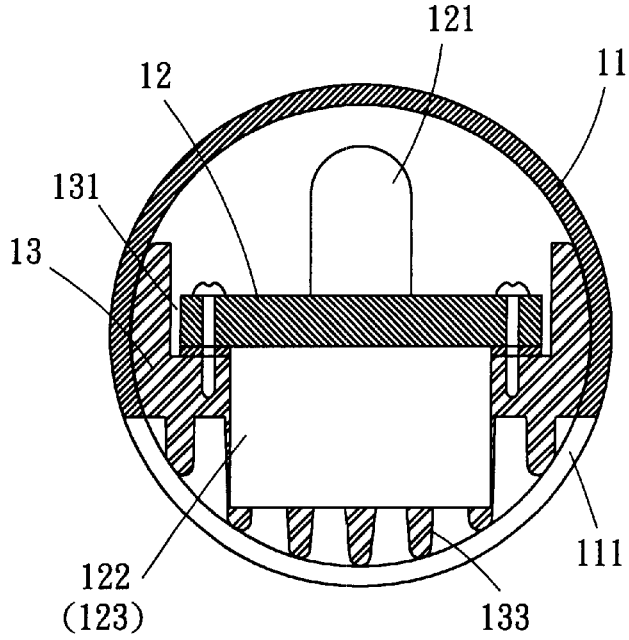
FIG. 3 is a transverse sectional view of the preferred embodiment.
Figure 4:
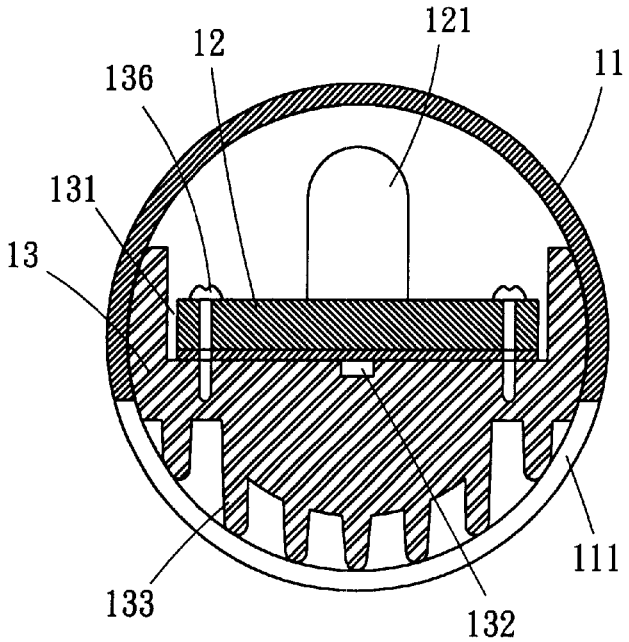
FIG. 4 is a transverse sectional view of the preferred embodiment at another position.

With reference to FIGS. 3 and 4, after assembly of the circuit board 12 with the LED light bulbs 121 and the boat-shaped receiving, heat-dissipating trough 13, the assembly can be placed inside a plastic transparent tube 11. The bottom wall of the transparent tube 11 is provided with heat-dissipating holes 111 that are equi-distantly spaced apart or continuously disposed. The two ends thereof are also pre-formed with through holes 112, 113, which are closed by two end stoppers 14, 15, thereby achieving a LED tubular lighting device capable of serial connection.

Figure 5:
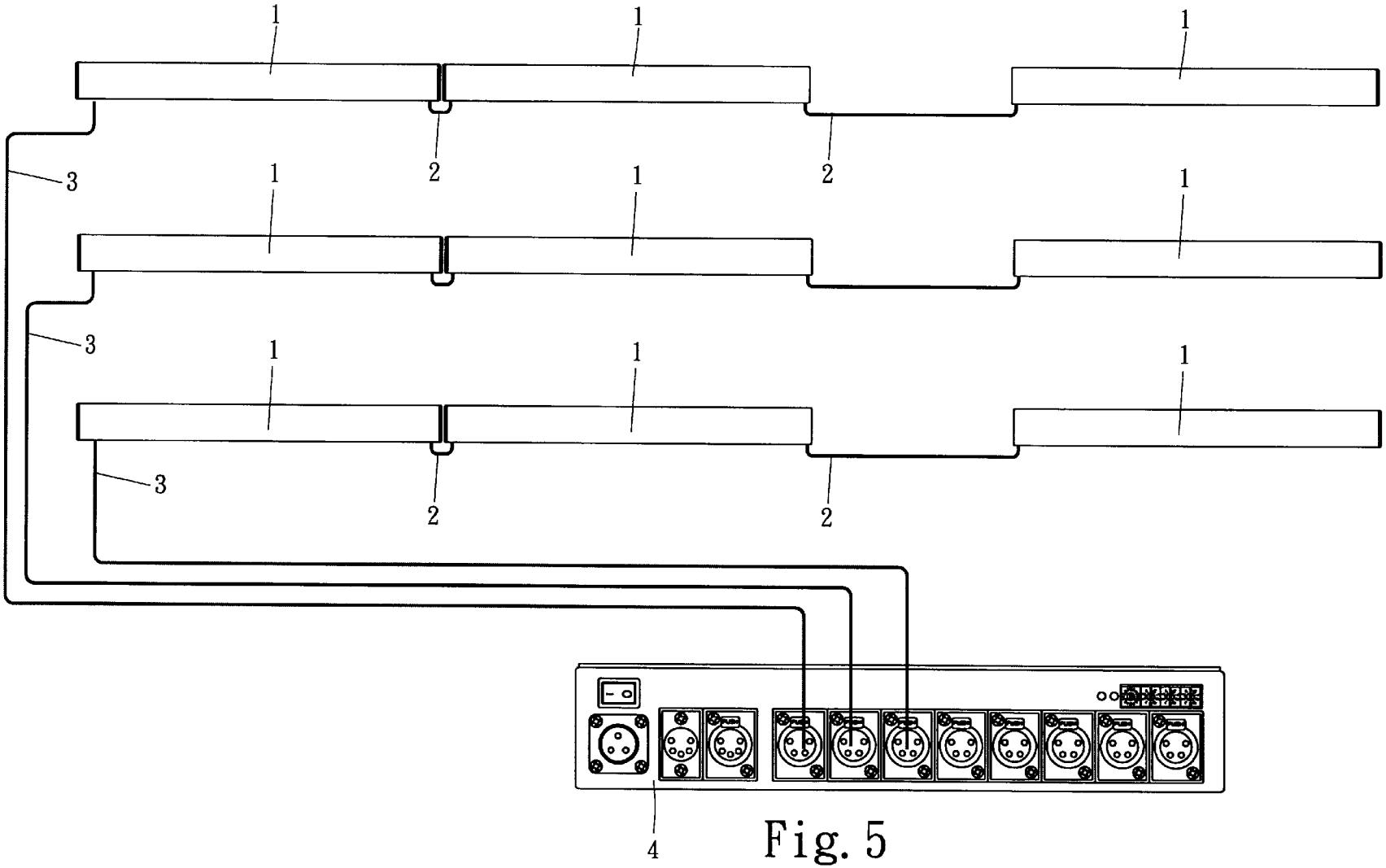
FIG. 5 is a schematic view of the LED tubular lighting device and a control device according to the present invention.

As shown in FIG. 5, a plurality of the LED tubular lighting device 1 of the present invention can be connected in series by means of connecting wires 2 with connecting terminals, and can be connected by lead wires 3 to a programmable control device 4. Through inputting commands into the programmable control device 4, the LED tubular lighting devices 1 may be caused to produce changes in color and luminosity.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An LED tubular light device and control device, comprising an LED tubular lighting device and a programmable control device, wherein said LED tubular light device includes:

a strip-shaped circuit board having a plurality of LED light bulbs equi-distantly disposed thereon, two ends of said circuit board being respectively provided with input and output terminals;

a plastic transparent tube having a bottom wall provided with heat-dissipating holes, and two ends pre-formed with through holes, closed by two end stoppers; and, a heat-dissipating trough being a semi-circular aluminum-extruded receiving, light-converging, heat-dissipating trough located in said plastic transparent tube, an upper side thereof having a groove receiving said circuit board holding said LED light bulbs, said groove being centrally provided with a longitudinal recess, a lower side of said heat-dissipating trough provided with heat-dissipating fins that follow a curvature of an inner surface of said plastic transparent tube, two ends of said groove provided with trough holes accommodating said input and output terminals to facilitate connection with a power source end, said circuit board together with said LED light bulbs being secured in position after being disposed in said trough.

2. The LED tubular lighting device and control device of claim 1, wherein a plurality of said LED tubular lighting devices are connected in series by connecting wires with connecting terminals.

3. The LED tubular lighting device and control device of claim 1, wherein said control device comprises a control device controlling serially connected LED tubular lighting devices via predetermined programs.

* * * * *